US007566023B2

(12) United States Patent
Bordignon et al.

(10) Patent No.: US 7,566,023 B2
(45) Date of Patent: Jul. 28, 2009

(54) COILING METHOD AND DEVICE FOR ROLLED OR DRAWN LONG PRODUCTS

(75) Inventors: Giuseppe Bordignon, Bicinicco (IT); Ivan Paiaro, Ronchi dei Legionari (IT); Andrea De Luca, Remanzacco (IT); Alfredo Poloni, Fogliano Redipuglia (IT)

(73) Assignee: Danieli & C. Officine Meccaniche SpA, Buttrio(UD) (IT)

( * ) Notice: Subject to any disclaimer, the term of this patent is extended or adjusted under 35 U.S.C. 154(b) by 338 days.

(21) Appl. No.: 10/597,228

(22) PCT Filed: Jan. 18, 2005

(86) PCT No.: PCT/IB2005/000111

§ 371 (c)(1),
(2), (4) Date: Jul. 17, 2006

(87) PCT Pub. No.: WO2005/077558

PCT Pub. Date: Aug. 25, 2005

(65) Prior Publication Data

US 2008/0217456 A1 Sep. 11, 2008

(30) Foreign Application Priority Data

Jan. 19, 2004 (IT) ..... UD2004A0008

(51) Int. Cl.
*B65H 65/00* (2006.01)

(52) U.S. Cl. ..... 242/476.6; 242/586

(58) Field of Classification Search ..... 242/362.2, 242/362.3, 363, 472.5, 476.1, 476.2, 476.6, 242/579, 585, 586, 586.4, 586.5, 597, 597.1
See application file for complete search history.

(56) References Cited

U.S. PATENT DOCUMENTS

| | | | | |
|---|---|---|---|---|
| 1,793,104 | A | 2/1931 | Einer | |
| 3,592,399 | A | 7/1971 | Woodrow | |
| 3,945,585 | A | 3/1976 | Moslener | |
| 6,318,660 | B1 * | 11/2001 | Bordignon et al. | 242/362.2 |

FOREIGN PATENT DOCUMENTS

| | | | |
|---|---|---|---|
| DE | 26 49 340 | A | 5/1978 |
| EP | 1 126 934 | B | 3/2003 |
| FR | 2 516 063 | A | 5/1983 |
| GB | 1 367 513 | A | 9/1974 |

* cited by examiner

*Primary Examiner*—Peter M Cuomo
*Assistant Examiner*—William E Dondero
(74) *Attorney, Agent, or Firm*—Gottlieb, Rackman & Reisman, P.C.

(57) ABSTRACT

Coiling method and device ("R") for a long product (10). The device ("R") comprises a mandrel (12) with a substantially cylindrical shape and rotating around its own axis, and a containing element (13) coaxial with the mandrel (12), rotating together therewith and defining a front wall (32) to contain the coil of product (10) to be formed. The containing element (13) comprises an annular channel (14) to clamp the leading end of the product (10) around the mandrel (12). The containing element (13) is mobile axially with respect to the mandrel (12) between a first position wherein the leading end of the product (10) is inserted, and a second position wherein the coil of product (10) is completed.

10 Claims, 6 Drawing Sheets

COILING METHOD AND DEVICE FOR ROLLED OR DRAWN LONG PRODUCTS

FIELD OF THE INVENTION

The present invention concerns a coiling device and the relative coiling method for long metal products, ferrous or not, as obtained from drawing or rolling operations, whether done hot or cold. To be more exact, the invention concerns the coiling of wire, bars, flat strips, rods (smooth or ribbed), or tubes, having a transverse section that is round, square, rectangular, hexagonal or otherwise, of various sizes.

To be more exact, the invention concerns the device to guide and contain the coiled product, on the winding mandrel, in order to contain it laterally and to impose on the forming coil the desired external form. The winding mandrel may have a horizontal, vertical or inclined axis of rotation.

The invention is applied to coiling machines with cantilevered axis.

BACKGROUND OF THE INVENTION

In the state of the art, the problems connected to coiling, on a continuously rotating mandrel, a long metal product, either rolled or drawn, traveling at high speed, to be wound in contiguous, adjacent and superimposed spirals, in a uniform manner, so as to form very compact coils, are known.

It is known that the operation to form the coil, so that the spirals are compact and uniformly distributed in every layer and for the whole longitudinal extension of the coil, is very delicate.

The problem of easily removing the finished coils from the mandrel is also known.

If the operation to remove the coil is not carried out correctly, defects may occur in the finished coils, such as for example the wound spirals may be released and/or the coiled roll may have a bad aesthetic appearance. Moreover, if the coil does not have a regular geometry, there are problems of stacking during the storage step, and also problems with installing the coil on the machine which uses the same, and problems with the correct unwinding of the coiled product.

It is also important to keep in mind the fact that if the leading end of the rolled product is not clamped as it arrives, a relative sliding occurs between the product and the mandrel, so that coiling cannot begin. On the other hand, if the leading end of the rolled product becomes detached from the clamping channel, after the formation of a few spirals (with the mandrel under torque and the rolled product already flowing), the tension of the coils is released, there is a consequent slippage between the parts and hence a blockage is created upstream of the coiling device, with all the problems that derive from this. Such a detachment during the coiling step is also facilitated by the progressive cooling of the rolled product which begins to shorten as it shrinks, starting from the leading end, thus causing a drawing effect that causes the leading end to come out of the gripping channel.

It is therefore of fundamental importance to be able to guarantee a secure and long-lasting clamping of the initial segment of the rolled product on the mandrel.

The European patent EP-B-1.126.934 discloses a coiling machine which comprises suitable guides, substantially semi-cylindrical in shape, otherwise known as flaps or insertion blades. Said guides are able to intercept the metal product to be wound, as it arrives from the rolling mill or the drawing machine, and are able to facilitate the formation of the first spirals of the coil on the mandrel. This known coiling machine, which has the axis of the mandrel cantilevered, also comprises a mobile containing plate to frontally contain the coil, which plate cooperates with the terminal, cantilevered part of the mandrel, and which can be arranged in the following two limit positions: a first position for the formation of the coil, wherein the containing plate is orthogonal to the axis of the mandrel and coaxial therewith, and a second position wherein the containing plate is rotated by about 90° and arranged substantially parallel to the axis of the mandrel, in a position of non-interference with the path on which the finished coil is discharged.

Before starting to distribute the spirals on the mandrel, it is necessary that the metal product to be wound is correctly gripped on the mandrel itself; to this purpose, it is necessary to provide a device that performs the clamping of the metal product to the mandrel with great reliability, precision and repeatability.

The U.S. Pat. No. 3,945,585 discloses a winding device for a rolled product with a circular section, arranged downstream of a production line for rolled product and comprising a drum-type mandrel, mounted cantilevered and formed by several independent segments movable radially between an expanded position, for winding the coil, and a contracted position in order to facilitate the expulsion of the coil after it has been formed. Coaxially with the mandrel a bell-type sleeve is arranged, axially movable, which is flared towards the winding surface of the mandrel and defines a locking surface for the leading end of the rolled product to be wound. In this way the first spirals of the coil are constantly locked between the sleeve and the mandrel, with the disadvantage that, once the coil has been completed, it will still have the first spirals protruding towards the outside of one of its lateral surfaces.

One purpose of the present invention is to achieve a coiling device for long metal products which will guarantee a considerable rapidity in installing the mobile frontal containing means that cooperate with the end part of the mandrel.

Another purpose of the invention is to guarantee the correct performance of the coiling process.

Another purpose pursued by the device according to the invention is to improve the quality of the final coil in terms of winding, compactness, density and holding capacity of the spirals.

A further purpose of the invention is to prevent damage and a reduced quality of the product.

It is also a purpose of the invention to simplify maintenance operations on said device.

The advantages achieved give a coil having a desired geometric profile which allows to exploit the storage space, also in height, to optimize the handling and transport steps, and gives a better functioning to the user machines, which can thus work at greater speed.

Applicant has devised, tested and embodied the present invention to overcome the shortcomings of the state of the art and to obtain these and other purposes and advantages.

SUMMARY OF THE INVENTION

The present invention is set forth and characterized in the main claims, while the dependent claims describe other characteristics of the present invention or variants to the main inventive idea.

In accordance with the above purposes, a coiling device for long products, whether they be rolled or drawn, according to the present invention is provided with a guide and containing device.

The device and method according to the present invention are applied to machines for coiling long metal products, obtained from rolling or drawing operations, whether performed hot or cold. The products can be irrespectively wire, bars, flat strips, rods (smooth or ribbed), tubes, both of ferrous material such as steels with low, medium or high carbon content, stainless steels, alloyed or other, and also non-ferrous material, such as aluminum, copper or other. The invention is applied to coiling or reeling machines which have a mandrel with a cantilevered axis.

Said long metal products can have any transverse section whatsoever, that is, round, square, rectangular, hexagonal or otherwise, particularly, but not restrictively, with diameters between 8 mm and 52 mm or, in the case of bars or flat strips, with a transverse section between 60 $mm^2$ (for example 20 mm ×3 mm) and 1400 $mm^2$ (for example 70 mm ×20 mm).

In the following description long metal product can be taken to mean any of the above products, and also any similar or comparable products, traveling up to more than 40-45 m/sec with an hourly production of 110 tonnes and more.

The clamping steps are performed substantially as follows. The leading end of the metal product enters into a device to distribute the spirals from which it is introduced, tangentially with respect to the reel, into a guide and containing device, or flap, which guides the leading end and contains the product by means of a groove.

Said guide and containing device generally consists of two flaps, an upper and a lower flap.

In cooperation with the guide and containing device there is a wall mobile axially to the mandrel, which has an annular containing channel, and which rotates together with the mandrel.

According to a variant, said annular channel has the outer surface conformed as a portion of a cone, in order to operate progressively on the product to be wound.

In order to anchor firmly the initial part of the metal product to be wound against the outer surface of the mandrel, a forming zone of improved adherence is provided on the mandrel, which cooperates with the leading end of the metal product to be wound in order to form at least a first spiral of the coil.

According to a variant, clamping means are provided which can clamp the metal product to be wound.

According to another variant, both these solutions are provided in combination with each other.

Once the metal product to be wound has been clamped to the mandrel, it is possible to open the flaps and start distributing the material onto the mandrel in order to complete the first layer of spirals.

During the production of the second layer of spirals, should the clamping means be provided, when the layer arrives in proximity with the clamping means, the latter are opened and the mobile wall retracted outside the afore-said forming zone, in order to leave space for the subsequent spirals and for the completion of the coil. In this way, all the spirals of the coil, also including the first, will be inside two plane lateral surfaces, advantageously parallel with each other, without any spiral protruding outside.

BRIEF DESCRIPTION OF THE DRAWINGS

Other purposes and advantages of the present invention will become apparent from the following description of a form of embodiment of a coiling device for metal products, given as a non-restrictive example with reference to the attached drawings wherein.

DETAILED DESCRIPTION OF A PREFERENTIAL FORM OF EMBODIMENT

Figure 1:
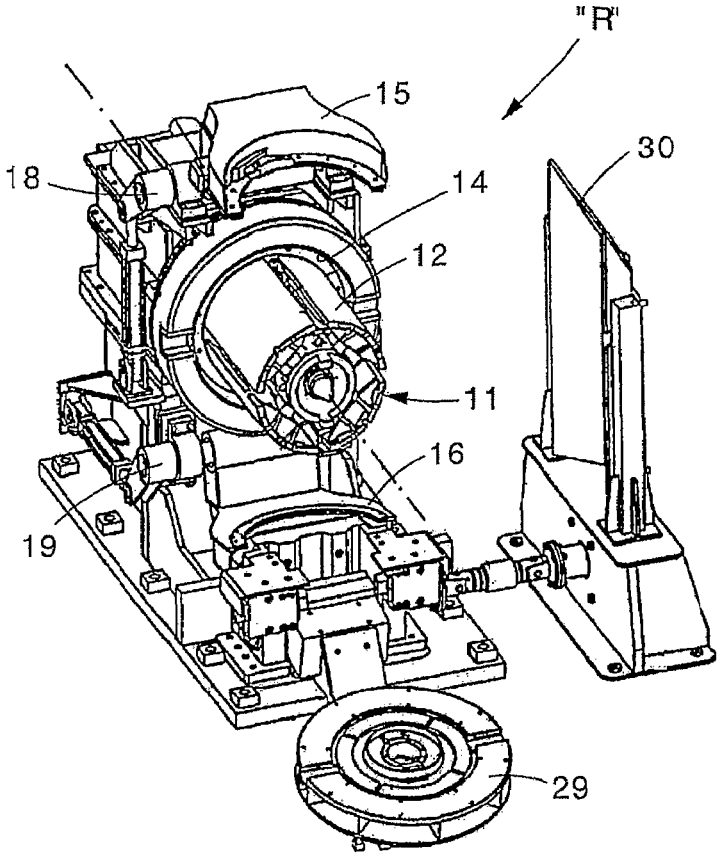
FIG. 1 is a perspective view of a known coiling device, in this case with a horizontal axis.

With reference to the attached drawings, a coiling device "R" is shown for metal products 10, such as bars, plates, rods (smooth or ribbed), having a transverse section that is round, square, rectangular, hexagonal or otherwise.

The metal product 10 to be wound is conveyed through a distribution device which distributes the metal product 10 in a uniform and desired manner on a reel 11, provided with a mandrel 12 rotating around its own axis, horizontal, vertical or inclined.

The mandrel 12 comprises an inner plate 13, arranged orthogonal to the axis of rotation of the mandrel 12, which defines one of the lateral walls between which the coil of metal product 10 to be wound is formed.

Hereafter, the various types of metal product 10 to be wound, as set forth above, shall be identified simply as metal wire 10.

Figure 2:
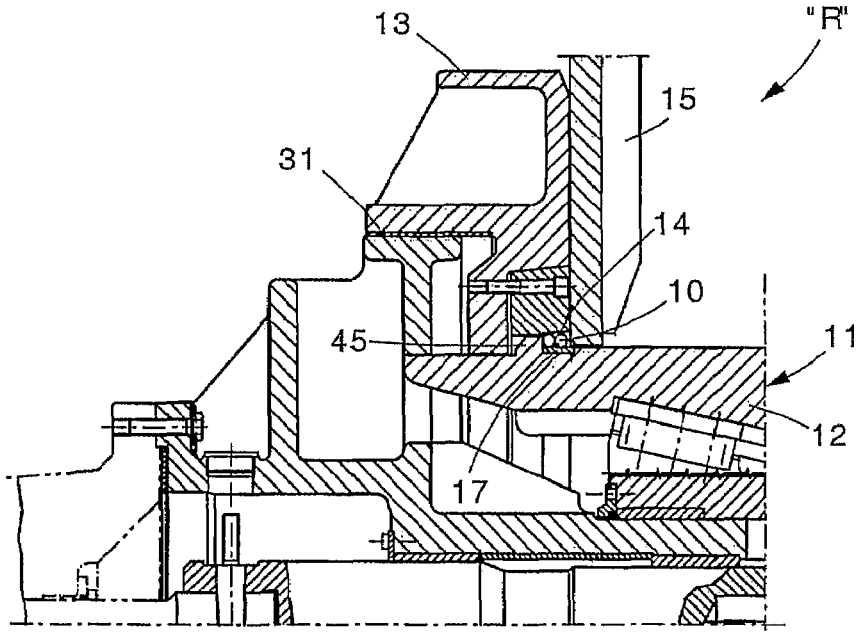
FIG. 2 shows the enlarged section of a detail of the coiling device according to the invention in a first operating step.

Said inner plate 13, in the case of FIG. 2, comprises an annular channel 14, which in the section view appears like a throat or groove of trapezoid shape, able to receive the leading end of the metal wire 10 and, thanks to the centrifugal force, to grip an initial segment thereof of a desired length.

In correspondence with the annular channel 14, the mandrel 12 according to a variant has a forming zone 17, advantageously with improved adherence on its outer surface. The zone 17 is able to retain the initial part of the metal wire 10, cooperating with said annular channel 14, also thanks to the action of friction. On the other end of the mandrel 12 there are containing means 29 movable between a working position, wherein they are arranged substantially orthogonal to the axis of rotation of the mandrel 12, and an inactive position, wherein they are separated from and lowered with respect to the mandrel 12 (FIG. 1).

Said containing means 29, in the working position wherein they are near the mandrel 12, have the double function of creating a lateral end abutment during the winding operation, cooperating to optimize the coil, and of cooperating with the mandrel 12, rotating with it which, if it has a horizontal axis, no longer works cantilevered.

In the inactive position the containing means 29 allow to remove the formed coil from the reel 11.

According to a first embodiment of the invention, the annular channel 14 is made on the inner plate 13.

According to a variant, the annular channel 14 is made in the containing means 29.

The coiling device "R" also comprises, in known manner, two guide and containing elements, having the form of two flaps 15, 16 which, in the case with a horizontal axis of rotation, are one upper and the other lower. The flaps 15, 16 are able to be driven by respective actuation mechanisms 18, 19, to be taken to, or distanced from, a respective working position. There may be one or more flaps.

The coiling device "R" can also possibly provide a protective screen 30, arranged to guarantee the safety of the operators.

In a variant embodiment of the coiling device "R" according to FIGS. 6 to 11, around the outer circumference of the mandrel 12 there is at least an clamping pincer 21, preferably four. The clamping pincers 21 are able to clamp the initial segment of the metal wire 10 and allow to clamp any type of metal product (for example smooth round pieces and plates) before the winding of the spirals is started.

According to a variant, it is possible to cover the entire circumference of the mandrel 12, creating a sort of "single continuous pincer", that is, a clamping ring.

The clamping pincers 21 are driven by an actuation device 26 (FIG. 8), of a known type, connected in this case to a thrust rod 27 which drives an arm 23 of the clamping pincer 21. By moving the rod 27 in the direction of the arrow 24, by means of the actuation device 26, the clamping pincer 21 is made to rotate around the axis A of a pin, and engages the metal wire 10 by means of a gripping surface 25.

The clamping pincers 21 are made so as to grip the metal wire 10 in different points of its initial segment, exerting a pressure thereon. Said pressure is exerted in the direction away from the surface of the mandrel 12.

According to a variant, said pressure is exerted towards the base of the mandrel 12.

The inner plate 13 is formed from the base of a substantially cylindrical element whose axis coincides with the axis of rotation of the mandrel 12. The inner plate 13 has an inner surface 31 for the axial sliding thereof, which allows the plate to assume two opposite extreme positions: a first advanced position and a second retracted position, by sliding parallel to the axis in the direction of the arrow 24 in FIG. 4. The advanced position of the inner plate 13, shown in FIGS. 2, 3, 6, 7, 8 and 9, is adopted in the initial step of clamping and winding the first spirals of metal wire 10.

Figure 4:
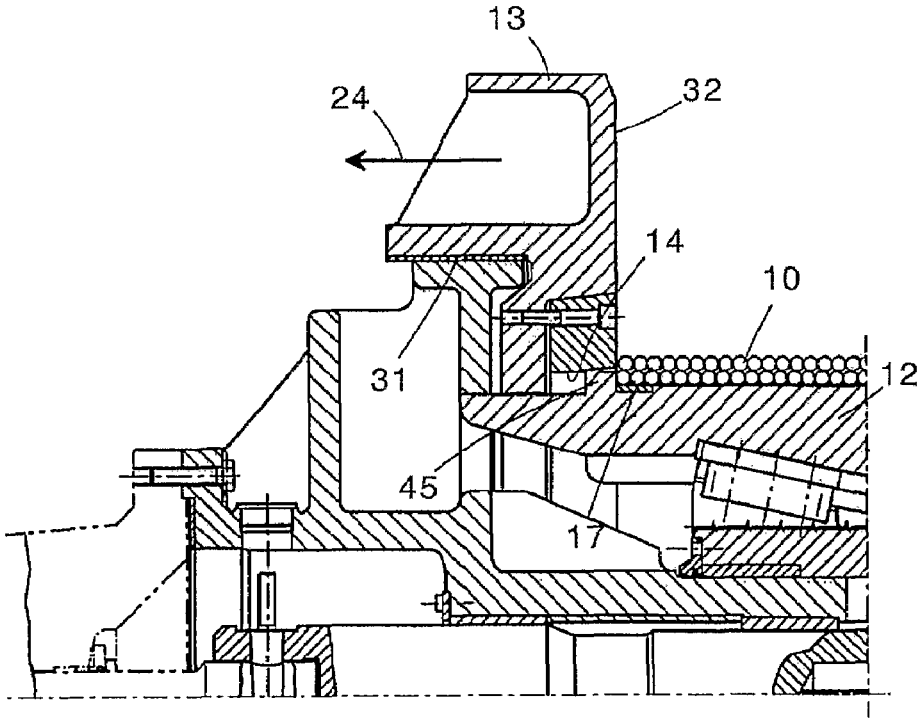
FIG. 4 shows the section of FIG. 2 in a third operating step.
Figure 5:
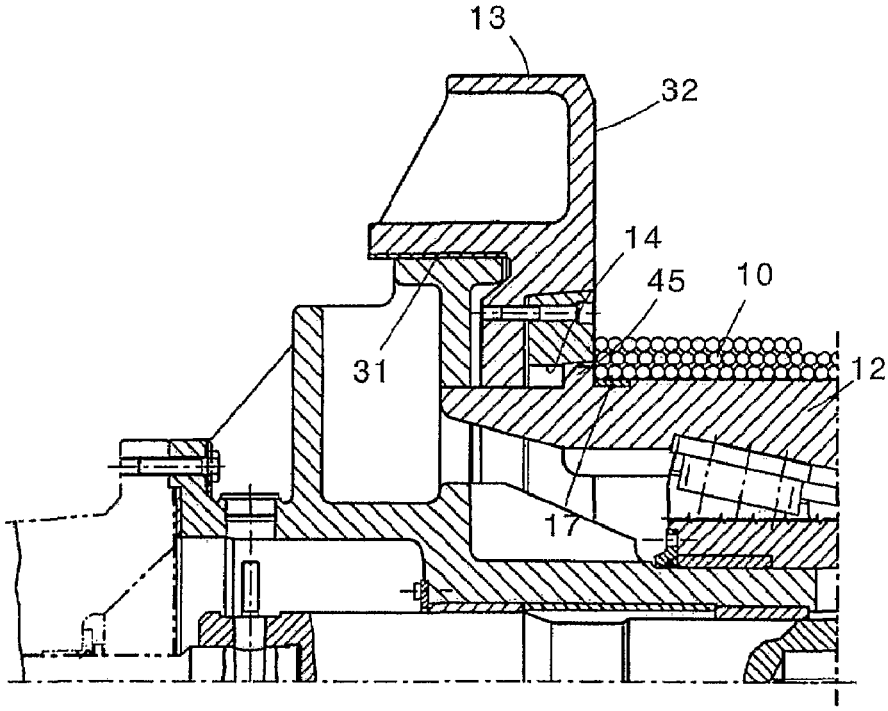
FIG. 5 shows the section of FIG. 2 in a fourth operating step.

The retracted position of the inner plate 13, shown in FIGS. 4, 5, 10 and 11, is adopted in the step of winding the subsequent layers of spirals. The axial retraction of the inner plate 13 advantageously occurs no later than when the layers of spirals of metal wire 10 have reached the radial height of the annular channel 14, and hence depending on the section size of the metal wire 10. In a particularly advantageous form of embodiment, the bottom lateral wall of the annular channel 14, parallel to a wall 32 of the inner plate 13, against which the first spirals of metal wire 10 abut, is made in the form of a ridge or annular tooth 45, attached solidly to, or as an integral part of, the mandrel 12. FIGS. 4 and 5 show how the first spirals of metal wire 10, in the retracted position of the inner plate 13, are retained on the outer surface of the mandrel 12 and are not drawn, for example due to friction, with the movement of the annular channel 14, caused by the movement of the inner plate 13.

The annular tooth or ridge 45 can be made either in a continuous form along the whole circumference, or alternatively interruptions of a suitable length may be provided along the circumference, for example to allow the clamping pincers 21 to be driven, in the form of embodiment in which they are provided.

Figure 10:
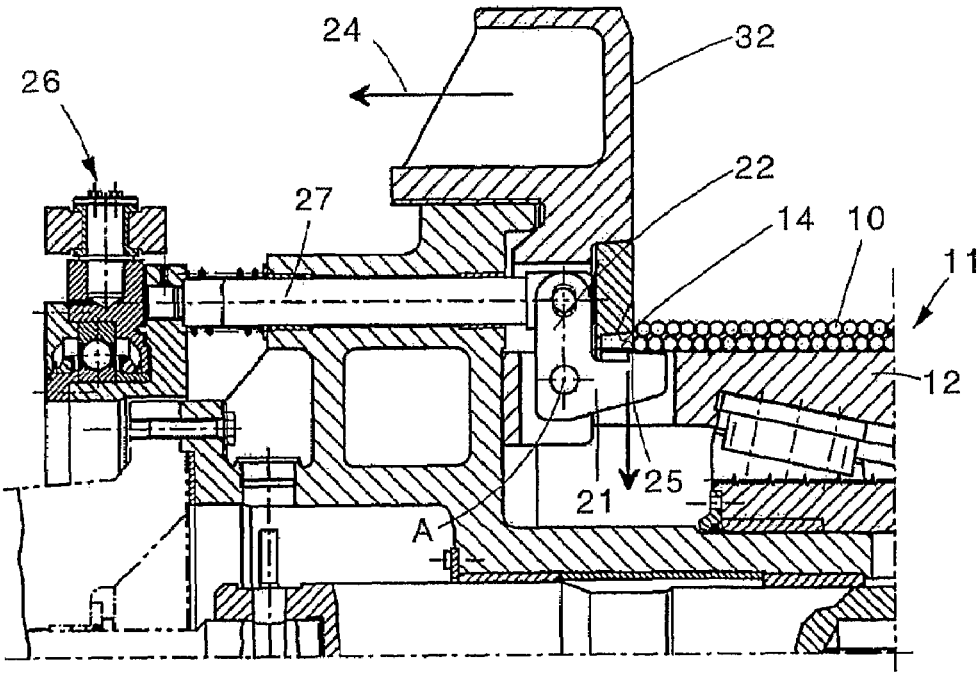
FIG. 10 shows the enlarged section of FIG. 6 in a fifth operating step.
Figure 11:
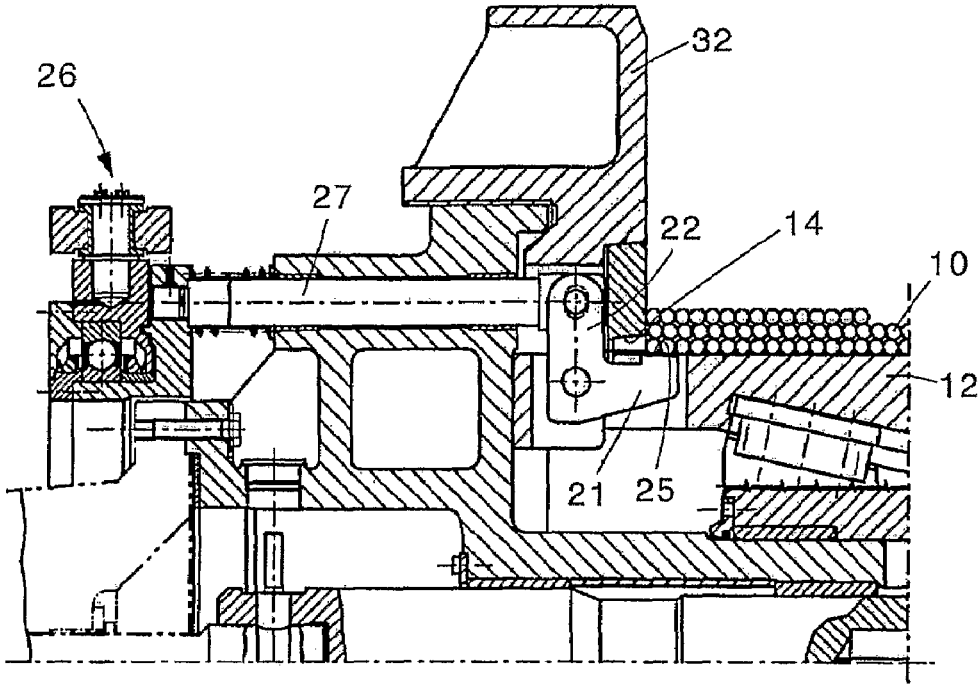
FIG. 11 shows the enlarged section of FIG. 6 in a sixth operating step.

This embodiment is shown by FIGS. 10 and 11 wherein, due to the position of the section plane, the tooth is not visible.

For the rest of the operation to wind the coil, the inner plate 13 is kept in the retracted position and will be returned to the extended position before the operation to wind the subsequent coil is started.

The device to axially displace the inner plate 13 is of a known type and is not shown in the drawings.

The coiling device functions as follows during the clamping steps.

First of all, the leading end of the metal wire 10 is made to enter into a groove of the flap 15, said groove cooperates with the surface of the mandrel 12 and has means that progressively displace the metal wire 10 sideways, until it cooperates with the zone where the metal wire 10 is clamped. The metal wire 10 is then thrust into the annular channel 14 made in the inner plate 13 of the mandrel 12.

In the annular channel 14, the initial segment of the metal wire 10 is clamped due to the effect of the centrifugal forces generated by the rotation of the mandrel 12 and the friction forces produced by the contact between the metal wire 10 itself and the walls delimiting the annular channel 14. In that form of embodiment wherein clamping pincers 21 are provided, clamping is achieved also thanks to the contribution of the pincers 21.

While clamping is performed, the mandrel 12 is rotating.

Figure 6:
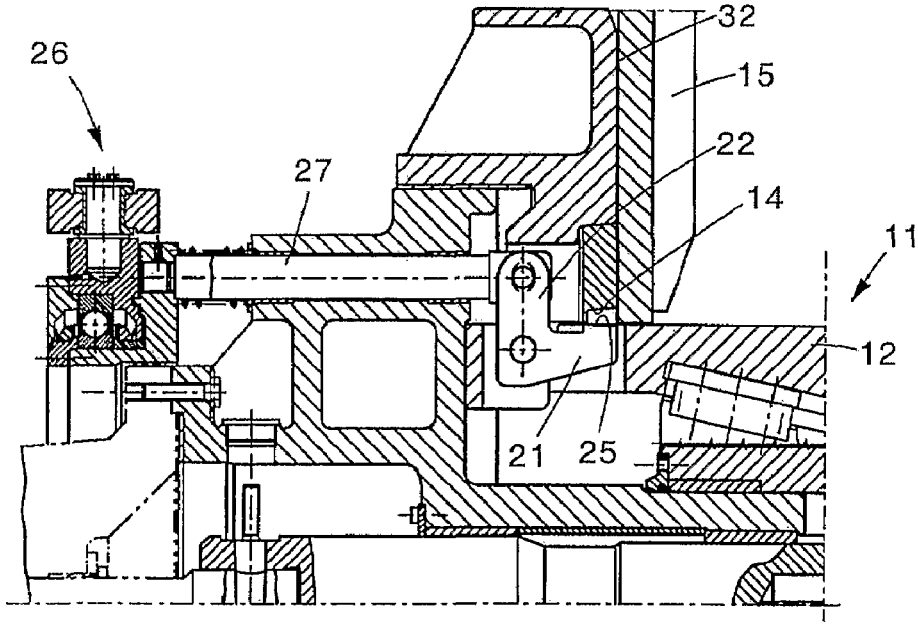
FIG. 6 shows the enlarged section of a detail of the coiling device in FIG. 1 according a form of embodiment of the invention in a first operating step.
Figure 7:
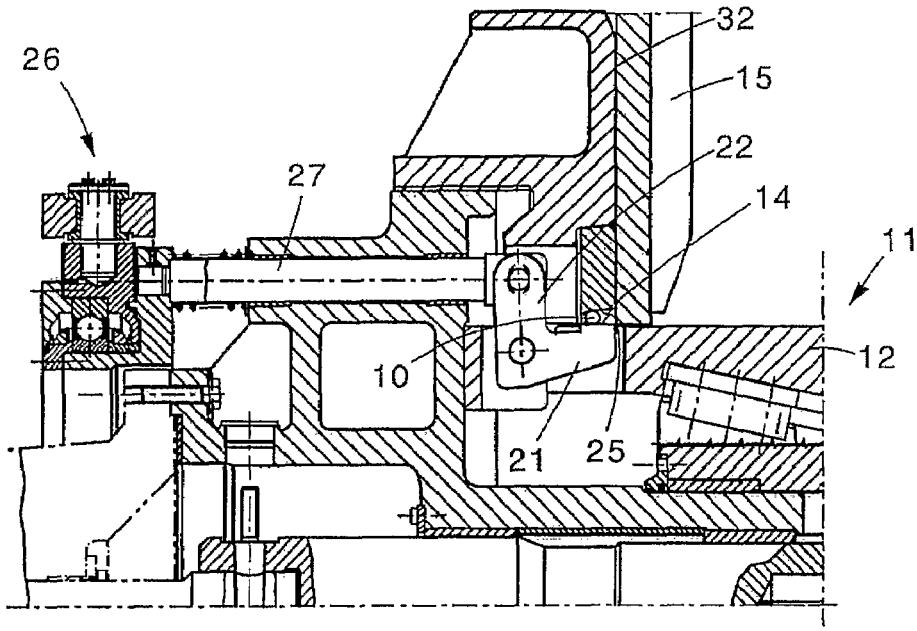
FIG. 7 shows the enlarged section of FIG. 6 in a second operating step.

In the first turn or turns, the metal wire 10 is wound while remaining almost entirely inside the annular channel 14. This step is shown in FIGS. 2, 6 and 7.

Subsequently, when the metal wire 10 is firmly gripped by the clamping pincers 21, the flaps 15, 16 are opened, and distanced from the wall 32 of the inner plate 13. Then it is possible to start distributing the metal wire 10 onto the mandrel 12.

Figure 3:
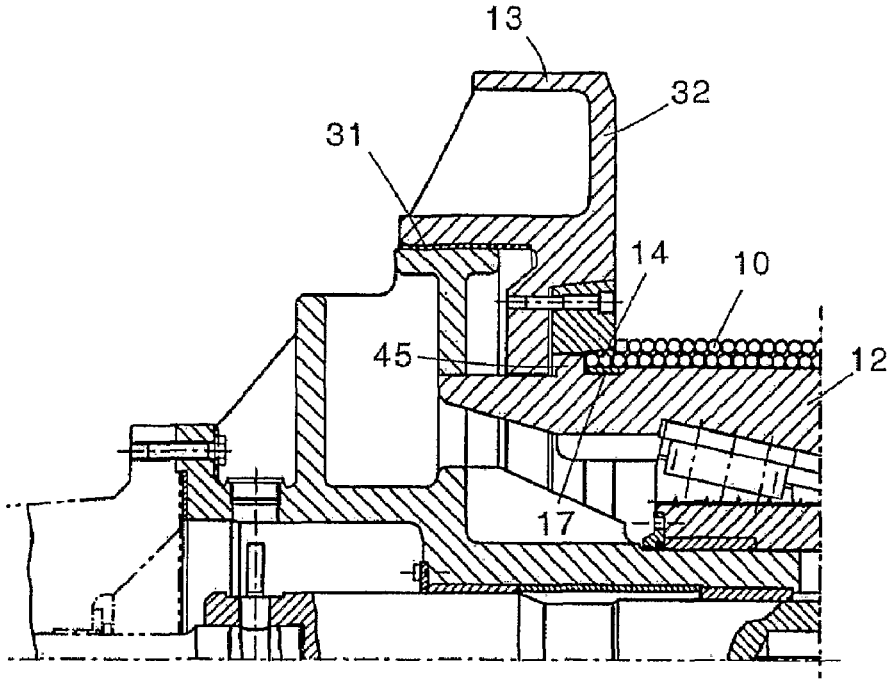
FIG. 3 shows the section of FIG. 2 in a second operating step.
Figure 8:
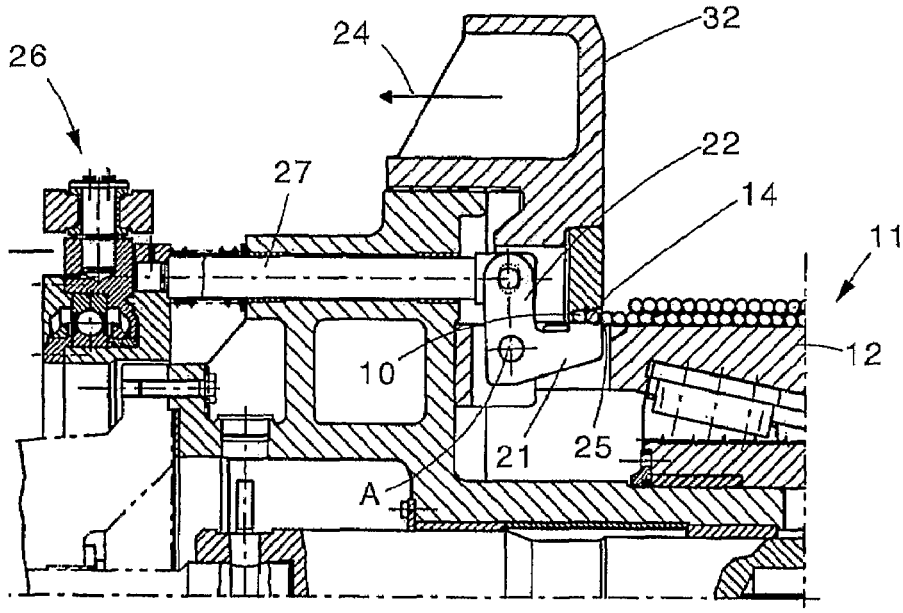
FIG. 8 shows the enlarged section of FIG. 6 in a third operating step.
Figure 9:
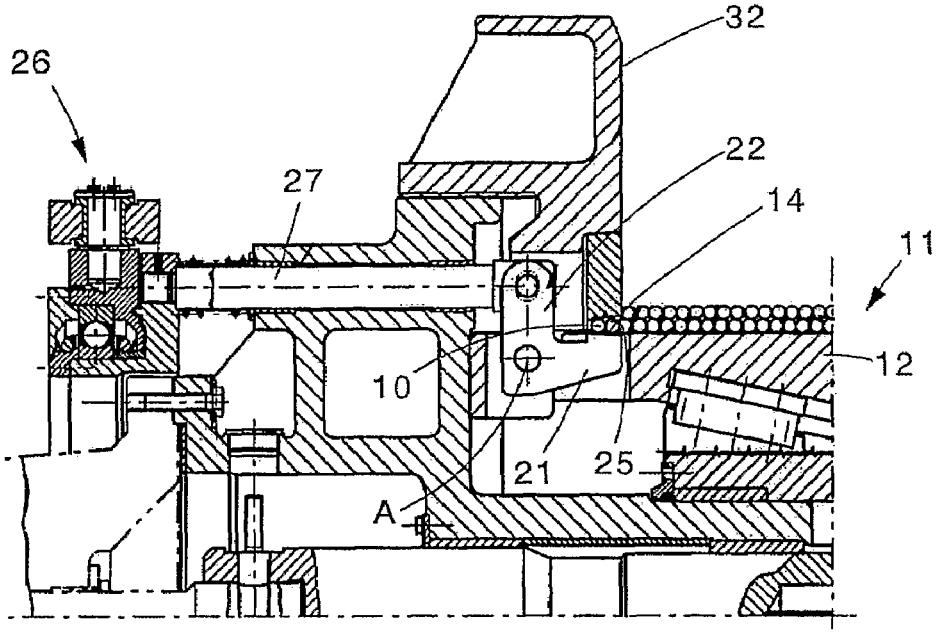
FIG. 9 shows the enlarged section of FIG. 6 in a fourth operating step.

In this way the annular channel 14 is open on one side. This step is shown in FIGS. 3, 8 and 9.

The system that controls the closing of the clamping pincers 21 and the system that controls the opening of the flaps 15 and 16 determine the exact moment that the distribution of spirals onto the mandrel 12 begins.

During the step of producing the second layer of spirals, when the layer arrives in proximity with the abutment with the wall 32 of the inner plate 13 which is in an advanced position, the clamping pincers 21 open, when such pincers are provided, and simultaneously the inner plate 13 retreats. Then, the distribution of the metal wire 10 continues until the layer reaches the wall 32 of the inner plate 13, which is in the retracted position, thus completing the second layer. In this way, the end spirals are aligned on the same plane.

Since then the wall 32 of the inner plate 13 remains level with the side of the first layer of spirals, thanks to the appropriate drive of the metal wire 10 distributor, it is possible to produce all the subsequent layers of spirals of metal wire 10 as far as the lateral limit defined by the first spiral.

The cylindrical coil which is obtained at the end of the coiling operation has its face that has formed during winding onto the mandrel 12, in contact with the inner plate 13 corresponding to the base of the cylinder, with a substantially plane close winding of the spirals, that is, without any spirals protruding laterally from the coil. Since the other face of the coil has been formed in contact with a regular plane surface, consisting of a cylindrical plate or of retaining flaps or other equivalent retaining device, in conclusion a super-compact cylindrical coil is obtained, with the faces plane and parallel without any spirals out of place.

Figure 12:
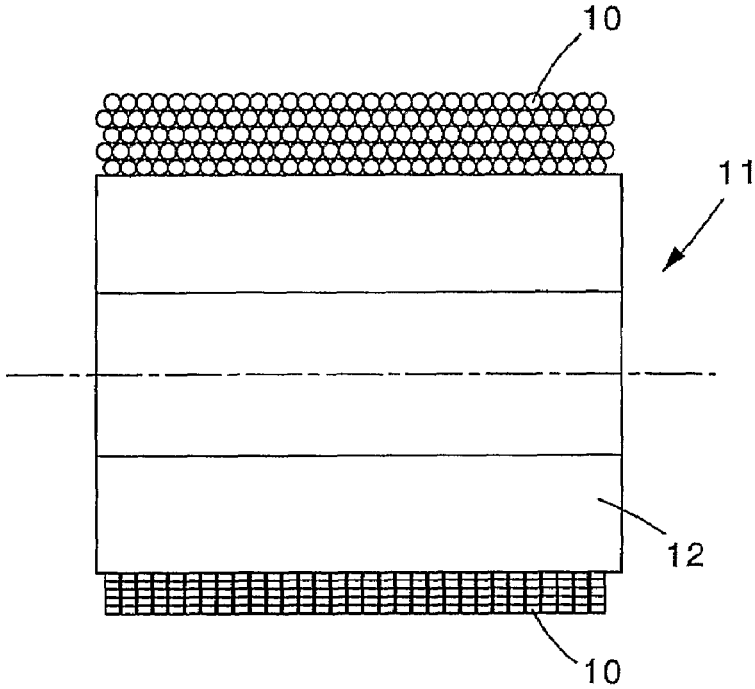
FIG. 12 shows the axial section of a reel of rolled product made with the device in FIG. 2, showing on one side how the winding of metal product with rectangular section appears, and on the other side how the winding of metal product in wire appears.

With the coiling device according to the invention rolls of great compactness and weight are obtained: the filling coefficient varies from 0.6 to 0.9 while the weight of the coil varies from 1500 to 5000 kg. The typical sizes of the coil are: inner diameter of between 700 mm and 900 mm, height between 700 mm and 900 mm, outer diameter variable according to the inner diameter, the height, the weight and the filling coefficient of the coiled roll. A coil of this type is shown in FIG. 12.

It is clear, however, that modifications and/or additions of parts may be made to the coiling device "R" as described heretofore, without departing from the field and scope of the present invention.

It is also clear that, although the present invention has been described with reference to specific examples, a person of skill in the art shall certainly be able to achieve many other equivalent forms of coiling device and method for rolled products, all of which shall come within the field and scope of the present invention.

The invention claimed is:

1. Device for coiling a long product comprising a mandrel with a substantially cylindrical shape and rotating around its own axis, and a containing element coaxial with said mandrel, rotating together therewith and defining a front wall to contain the coil of product to be formed, wherein said mandrel comprises a forming zone for at least a first spiral of said coil, wherein said containing element comprises an annular channel to clamp the leading end of said product around said mandrel, and wherein said containing element is axially movable with respect to said mandrel between a first position in which said leading end of said product is inserted and said annular channel is arranged in correspondence with said forming zone, and a second position for forming at least one subsequent spiral in which said coil of product is completed and said annular channel is displaced from said forming zone, said containing element remaining in said first position temporarily and said second position being retracted with respect to said mandrel so that said annular channel is outside the space occupied by said coil during the completion of said coil, wherein said at least one subsequent spiral is parallel with said first spiral with no subsequent spirals protruding laterally with respect to said first spiral after completion of said coil and aligned on a plane transverse to said first spiral.

2. Device as in claim 1, wherein said containing element includes an axially sliding inner surface which allows said containing element to slide axially between said first and said second position.

3. Device as in claim 1, wherein at least a guide and containing device is provided to be driven between a first working position in which said guide and containing device cooperates with said containing element, and a second inactive position in which said guide and containing device is arranged distant from said containing element.

4. Device as in claim 1, wherein clamping means associated with said mandrel are provided to clamp at least temporarily said leading end of said product.

5. Device as in claim 4, wherein said clamping means comprise pincer means able to be selectively activated, and arranged in correspondence with said forming zone of said mandrel.

6. Device as in claim 1, wherein a lateral wall of said annular channel is parallel to said front wall of said containing element, at least the first spiral of said product being able to abut against said lateral wall.

7. Device as in claim 6, wherein said lateral wall is made in the form of a ridge or annular tooth, attached solidly to or as an integral part of said mandrel.

8. Method for coiling a long product achieved by means of a device that comprises a mandrel with a substantially cylindrical shape and rotating around its own axis, and a containing element coaxial with said mandrel, rotating together therewith and defining a front wall to contain the coil of product to be formed, said method comprising the following steps:

a first step wherein a leading end of said product is inserted into a guide and containing device able to guide said leading end to a position substantially tangent to a determinate forming zone of said mandrel, said first step occurring while said containing element is in a first position for the insertion of said leading end of said product, substantially in correspondence with said determinate forming zone of said mandrel;

a second step wherein said leading end of said product is introduced into an annular channel of said containing element;

a third step wherein at least the first spiral of said product is formed inside said containing element around said mandrel; and a fourth step wherein said containing element is displaced axially with respect to said mandrel to a second position for forming at least one subsequent spiral to complete said coil of product, in which second position and said annular channel is displaced from said forming zone, in a retracted position with respect to said mandrel so that said annular channel is outside the space occupied by said coil during the completion of said coil, wherein said at least one subsequent spiral is parallel with said first spiral with no subsequent spirals protruding laterally with respect to said first spiral after completion of said coil and aligned on a plane transverse to said first spiral.

9. Method as in claim 8, wherein during said fourth step said guide and containing device is distanced from said mandrel.

10. Method as in claim 8, wherein between the second and the third step clamping means able to keep the leading end of said product stationary with respect to said mandrel are temporarily driven.

* * * * *